United States Patent [19]

Vershinsky et al.

[11] 4,022,266

[45] May 10, 1977

[54] INSTALLATION FOR ELECTROHYDRAULIC KNOCKOUT OF CASTING CORES

[76] Inventors: Georgy Ottovich Vershinsky, ulitsa Bairona, 6/20, kv. 2; Evgeny Alexeevich Perfiliev, ulitsa 23 Avgusta, 26, kv. 32; Georgy Dmitrievich Kharlan, ulitsa Turgenevskaya, 7, kv. 5, all of Kharkov, U.S.S.R.

[22] Filed: June 14, 1976

[21] Appl. No.: 696,044

[52] U.S. Cl. ..... 164/250; 164/404; 134/1; 164/132

[51] Int. Cl.[2] ..... B22D 29/00

[58] Field of Search ..... 164/132, 345, 401, 403, 164/404, 48, 49, 131, 250, 252, 344; 134/1

[56] References Cited

UNITED STATES PATENTS

| | | | |
|---|---|---|---|
| 3,845,806 | 11/1974 | Schekin et al. | 164/404 X |

FOREIGN PATENTS OR APPLICATIONS

| | | | |
|---|---|---|---|
| 1,111,901 | 7/1961 | Germany | 134/1 |
| 1,303,223 | 1/1973 | United Kingdom | 164/404 |
| 1,312,173 | 4/1973 | United Kingdom | 164/132 |
| 126,585 | 11/1959 | U.S.S.R. | 164/48 |
| 212,470 | 9/1968 | U.S.S.R. | 164/131 |

*Primary Examiner*—Ronald J. Shore
*Attorney, Agent, or Firm*—Lackenbach, Lilling & Siegel

[57] ABSTRACT

The installation comprises a liquid container and an electrode holder located above said container and mounted with a provision for moving the electrode to the preset position relative to the casting. The container shell is made of two telescopically jointed parts with a pneumatic seal on the joint. Secured rigidly at the level of the upper face of the lower part of the shell is a casting support. A special mechanism delivers the casting onto the support and removes it therefrom. The casting is placed on the support with the upper part of the shell lowered which allows the positioning of the electrodes above the casting to be controlled visually. Then the movable part of the shell is raised, filled with water so as to cover the casting completely, and the cores are knocked out.

4 Claims, 2 Drawing Figures

INSTALLATION FOR ELECTROHYDRAULIC KNOCKOUT OF CASTING CORES

The present invention relates to the field of machine-building and, more particularly, to installations for electrohydraulic knock out of casting cores.

The present invention can be used to best advantage for knocking-out cores from complex-shape castings, said cores being made of strong and hard-to-remove materials, e.g. soluble-glass mixtures with chemical solidification, graphitized or corundum mixtures with ethyl-silicate binder.

The most common installations for electrohydraulic knockout of casting cores existing nowadays comprise a liquid container, e.g. a tank, and at least one electrode holder mounted on a jib or on a gantry crane above said container with a provision for moving the electrode to the preset position relative to the casting core. The installation is provided with a load-hoisting mechanism for dipping the casting into a water-filled container and removing it therefrom.

The electrohydraulic knockout of casting cores utilizes the ability of an electric discharge to create shock waves in water and high pressures in the zone adjoining the channel of the electric discharge and to move the masses of liquid under the effect of the expanding steam-gas bubble in the zone of discharge and of the cavitation shock wave after the dissipation of the steam-gas bubble.

All the phenomena listed above create the conditions for the destruction of solid bodies which is utilized for knocking the cores out of the castings.

To ensure electrohydraulic knockout of casting cores the electrode is placed above the casting and dipped into water. In view of the fact that the casting is covered by a layer of non-transparent liquid, accurate location of the electrode above the casting core becomes difficult which adversely affects the quality of work.

In addition, the electrode has to be transferred through considerable distances so that the length of the power cable grows to such an extent that it increases the inductance of the discharge circuit and results in considerable losses of electric power.

Therefore, the improvement of such installations has been achieved by increasing the accuracy of placing the electrodes above the cores in the castings.

For this purpose there have been attempts to provide the installation with a manipulator for lowering the casting into water, first positioning the electrode above the casting.

However, it was impossible to lower the casting in complete synchronism with the electrode, the casting was shifted relative to the electrode and the length of the power cables grew still more.

Further, the mechanism of the manipulator proved to be cumbersome, difficult to control and unreliable.

In order to improve the installations and eliminate the abovementioned disadvantages an attempt has been made to position the electrodes with the aid of a reference grid and to fix the casting in a preset position.

But this also proved to be practically unattainable since it was impossible to fix accurately the castings covered with a layer of stuck moulding sand mixtures.

Preliminary removal of the moulding sand mixture from the casting and removal of gates and flash which interefere with accurate fixing of the casting on the manipulator support require additional equipment and servicing personnel who have to work in polluted atmosphere. In addition, there is a need for a considerable number of templets which, in turn, complicate the work of the operator. Even if all these requirements have been satisfied, the accuracy of positioning electrodes above the casting cores does not meet the up-to-date standards of production technology, particularly in the case of small-scale production of shaped castings.

So far not a single one of the known installations with movable casting support is known to ensure operation with the electrohydraulic energy discharge pulse accurately directed onto the casting core.

As proved by the investigations of the Authors, the most effective destruction of the core and its knocking out takes place when the entire energy of the pulse in the form of destructive waves is introduced into the casting and applied directly to the destructible body, i.e. the core.

Up to the present time the known installations fail to knock out the cores from shaped castings where the cores are characterized by a high residual strength amounting to 100–200 kg/cm$^2$.

In such installations the cores have to be knocked out several times and the remaining material of the core is removed from the castings with pick hammers.

All this raises considerably the cost of core knockout, increases the consumption of power and calls for the employment of additional tools and operators.

The development of machine-building has stepped up sharply the demand for shaped castings with accurately removed cores which has increased the scope of work related to cleaning the castings of cores.

The soluble-glass mixtures with ferro-chrome slags used for making cores cause the operating personnel to suffer from silicosis, vibration disease and eczema due to the heavy pollution of the atmosphere at the places where the cores are additionally removed from the castings with the aid of pick hammers.

The problem of providing an installation for electrohydraulic knockout of casting cores meeting the requirements of modern technology has grown into a pressing necessity.

The main object of the present invention is to provide an installation for electrohydraulic knockout of casting cores which would ensure high-quality processing of castings as compared with the quality attained so far on the existing installations of the similar application.

Another not less important object of the invention is to increase the output of the installation by reducing the time required for completely knocking the cores out of the castings.

An important object of the invention is to ensure reliability of the installation.

And another not less important object of the invention is to ensure efficient visual control of positioning the electrodes above the preset sections of the casting and to rule out the shifting of said casting due to stationary fixing of the casting support.

These and other objects are accomplished by providing an installation for electrohydraulic knockout of casting cores comprising a liquid container made in the form of a shell, a mechanism for delivering the casting onto the support and for removing it therefrom, and at least one electrode holder mounted above said container with a provision for moving the electrode to the preset position relative to the casting core. According to the invention, the container shell is provided with a movable upper part jointed telescopically with a lower part and has a pneumatic seal at the point of the joint. The space of the extended movable upper part of the container shell supplements the space of the lower part and communicates therewith. The casting support is arranged practically level with the upper face of the lower part of the container shell and is rigidly fixed in position.

Such a layout of the installation with the movable (lowering) upper part of the container shell and a pneumatic seal at the point of the joint ensures the requisite accuracy of positioning the electrodes above the casting cores due to visual control of the movement of the electrodes above the cores of the casting placed on a stationary support. This provides for the most favourable conditions of the process with the energy of the pulse accurately aimed at the core inside the casting which ensures a high quality of knocking out because the energy of the pulse acts directly on the destructible body. The improved quality of knocking out is accompanied by a higher output and reduced power expenditures. The design of the installation is considerably simplified along with a reduction in the length of the power cables and discharge circuit.

The installation is reliable and easy to operate.

Owing to good visibility the operator spends considerably less time bringing the electrodes to the preset position. The installation is suitable for knocking the cores out of the castings of any complex shape both in small- and large-scale production. In the first case the operator positions the electrodes in a minimum time of the frequently-changing types of castings; in the second case, once having positioned the electrodes, the operator does not change their position for the entire series of similar castings.

Refitting the installation for a new series of castings takes as little time as refitting for individual different castings.

It is practicable that the length of the movable upper part of the container shell should be sufficient for lifting the upper face of this part in the extended position by approximately 0.6m above the upper most point of the casting placed into the installation.

This length of the movable upper part of the container shell is sufficient to prevent the water from being thrown out in the course of electric discharges. Greater length is objectionable since it will call for lengthening the electrodes.

It is practicable that the lower part of the container shell should have a bell section whose volume is nearly equal to that of the extended movable upper part of the container shell and communicates therewith and with a source of compressed air, said source supplying enough air for forcing the liquid from the bell section which is provided with an air admission valve and an air-discharge valve.

The bell section is periodically filled either with liquid when the movable part of the shell is lowered and located in the lower part of the container shell, or with air when said movable upper part of the container shell is extended upward and is being filled with liquid. This simplifies considerably the process of admission and discharge of liquid from the upper movable part of the container shell into its lower part.

The admission valve ensures rapid filling of the bell section with compressed air from a high-pressure system (about 5–6 atm gauge).

The compressed air discharge valve provides for a rapid drop of the liquid level in the movable upper part of the shell because the pressure of compressed air in this case is not higher than 0.3 atm gauge. Such a layout of the bell section in the installation for electrohydraulic knockout of casting cores ensures simplicity and reliability of the design since it despenses with any additional containers and mechanisms for receiving the liquid from the movable upper part of the container shell before it is lowered into the lower part of the container shell.

Said bell section of the container shell can be formed between the wall of the lower part of the container shell and a vertical circular partition arranged coaxially with said wall and secured practically level with its upper face.

This is the simplest layout of the bell section which does not require any additional area since it fits snugly into the lower part of the shell.

Besides, the area through the circular hole with which the bell section communicates with the container shell is so large as to offer no resistance to the flow of the liquid forced out by the compressed air. This provides for the necessary velocity of the liquid when it is forced out and flows back into the bell section through the corresponding valves.

Now the invention will be described in detail by way of example with reference to the accompanying drawings in which.

Figure 2:
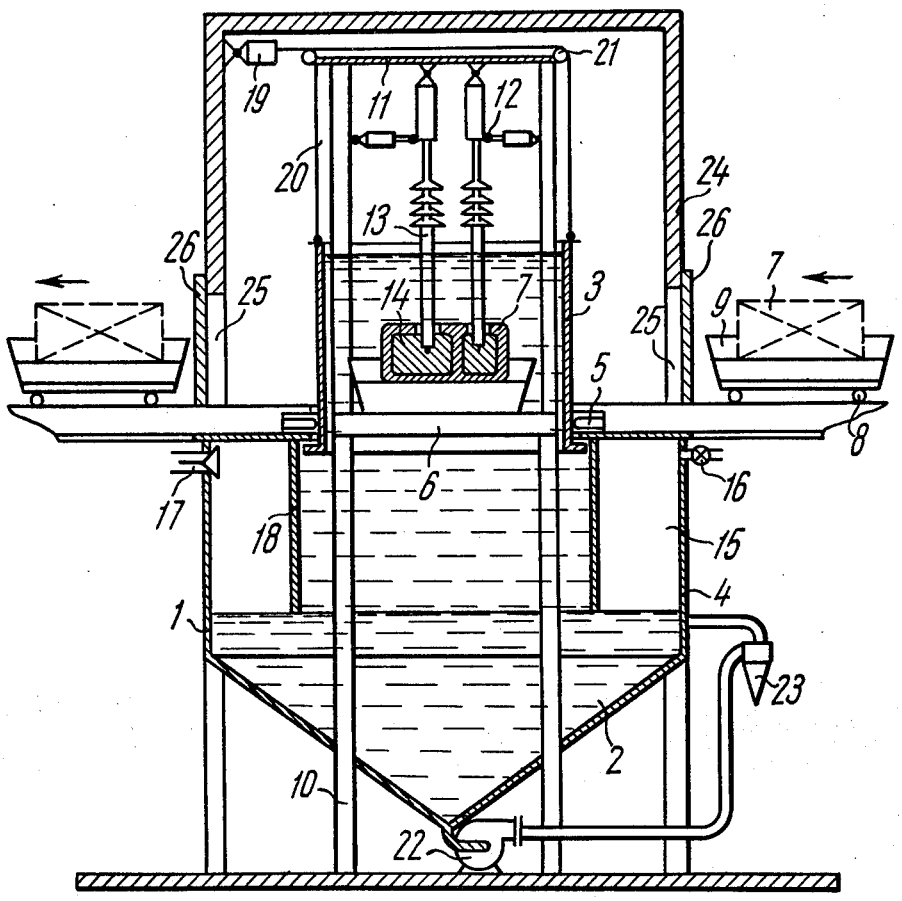
FIG. 2 shows a vertical section through the longitudinal axis in the direction of the arrows of FIG. 1 of the same installation.

The installation for electrohydraulic knockout of casting cores comprises a liquid container 2 (FIG. 2) in the form of a shell 1, said shell consisting of a movable upper part 3 telescopically jointed with a lower part 4. The jointing zone between said parts is provided with a pneumatic seal 5. When the shell 1 is extended, the space of the upper part 3 supplements that of the lower part 4 and communicates with it. The support 6 for the casting 7 is rigidly fixed practically level with the upper face of the lower part 4 of the container shell 1.

The installation is provided with a mechanism 8 for delivering the casting 7 onto the support 6 and for removing it therefrom.

The mechanism 8 for handling the castings 7 placed on the tray 9 can be constituted by a power-operated trolley or by a pusher (not shown in the drawing).

The columns 10 which serve as guides for the movable upper part 3 of the shell carry a platform 11 with at least one electrode holder 12 which is mounted so that it is capable of moving the electrode 13 to the preset position relative to the core 14 of the casting 7.

The length of the movable upper part 3 of the shell is selected so that in the extended position its upper face would rise by at least 0.6 m above the highest point of the casting 7 placed on the tray 9 which, in turn, is placed on the support 6. This prevents the liquid from being thrown out of the container in the course of electric discharges.

The lower part 4 of the container shell 1 has a bell section 15 whose volume is nearly equal to that of the extended movable upper part 3 of the container shell and communicates with it. The bell section 15 has an air admission valve 16 and a valve 17 for discharging the air flowing from the compressed air source (not shown in the drawings). The source of compressed air should be sufficient for delivering the air in the amount and at the pressure required for forcing the liquid out of the bell section 15 of the container shell 1 and delivering it into the movable upper part 3 of the container shell 1.

Said bell section 15 is limited by the wall of the lower part 4 of the container shell 1 and by a vertical circular partition 18 arranged coaxially with said wall and secured level with its upper face. The drive for shifting the movable upper part 3 of the container shell comprises a hydraulic cylinder 19 connected to the shell by cables 20 suspended from sheaves 21.

The slime formed during the destruction of the cores 14 of the casting 7 is continuously removed by a centrifugal sand pump 22 connected to the narrow bottom part of the container shell 1 and to a hydraulic cyclone 23.

The electrohydraulic installation is located in a soundproofed room with brick or concrete walls 24 provided with openings 25 which are closed by shutters 26.

The operator's workplace 27 is located remotely from the installation at the control panel 28 opposite the port 29 for visual control of the movement of the electrodes 13 and the operation of the installation.

The electrohydraulic installation for knockout of casting cores functions as follows.

The casting 7 (FIG. 1) is placed on the tray 9 with the ends of the cores 14 (FIG. 2) directed towards the electrodes 13. This position of the casting 7 is best for knocking the cores 14 out of the casting 7 by the energy of the pulse accurately directed onto the body of the core 14. The tray 9 with the casting 7 is delivered by a bridge crane (not shown in the drawing) to the mechanism 8 which carries the tray 9 with the casting 7 to the installation. The operator at the control panel 28 (FIG. 1) lifts the shutters 26 (FIG. 2) and uncovers the openings 25. Simultaneously, he turns on the drive 19 which brings the movable upper part 3 of the container shell to the lower position with the aid of the cables 20 suspended from sheaves 21. Then the mechanism 8 delivers the tray 9 with the casting 7 onto the support 6 after which the mechanism 8 is returned to the initial position to receive the next casting 7.

Figure 1:
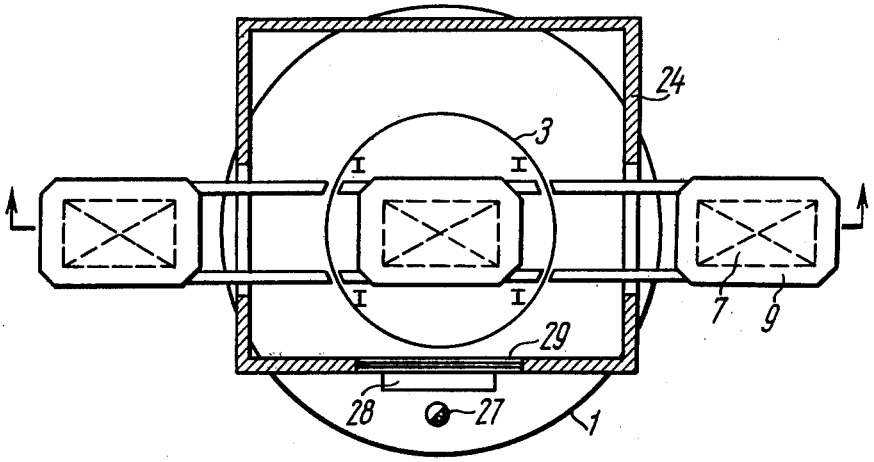
FIG. 1 shows a plan view of the installation according to the invention.

The operator at the control panel 28 (FIG. 1) positions the electodes 13 (FIG. 2) above the ends of the cores 14 in the casting 7, watching the operation through the port 29 (FIG. 1).

Then the operator turns on the drive 19 (FIG. 2) for lifting the movable upper part 3 of the container shell 1 and simultaneously lowers the shutters 26 to cover the openings 25. Then he admits compressed air into the space of the pneumatic seal 5 which seals the telescopic joint between the upper 3 and lower 4 parts of the container shell 1. He opens the valve 16 and the air from the compressed air source (not shown in the drawing) enters the bell section 15, forcing the liquid therefrom into the movable upper part 3 of the container shell.

The volume of the liquid forced out of the bell section 15 is sufficient to raise the liquid level above the uppermost point of the casting 7 by 0.6 m approximately after which the air admission valve 16 is closed.

This completes the preliminary operations and the operator turns on the high-voltage supply to the electrodes 13 from the pulse generators (not shown in the drawing).

The spark discharges jumping the gap between the electrode 13 and casting 7 destroy the core 14 by creating high-pressure zones and shock waves.

The core 14 is knocked out by series of pulse discharges. On completion of the knockout process, after a signal of programmed pulse counter on the control panel 28 (FIG. 1), the high-voltage supply is turned off, the valve 17 (FIG. 2) is opened and the compressed air is expelled from the bell section 15 by the hydrostatic column of liquid in the movable upper part 3 of the container shell. The liquid level in the movable upper part 3 of the container shell drops to the initial mark (below the level of the support 6).

The air is released from the pneumatic seal 5, the drive 19 is turned on the the movable upper part 3 of the container shell is lowered. Simultaneously, the shutters 26 are lifted thus uncovering the openings 25. The processed casting 7 together with the tray 9 is removed from the installation with the aid of the mechanism 8 after which the installation is ready for knocking out the cores from the next casting 7 and the operating cycle is repeated over again.

As the liquid becomes gradually polluted by the particles of destroyed cores, a special device is set in operation for continuous removal of slime by means of the pump 22 (FIG. 2) and hydraulic cyclone. There is a provision for returning the clarified water back into the container which cuts down the water consumption and makes the installation more economical.

All the above operations can be performed automatically or under manual control, besides positioning the electrodes in the preset points of the casting which is done by the operator under visual control.

The control systems incorporate interlock devices ensuring perfect safety both under automatic and manual-control conditions.

The electrohydraulic installation for knocking out casting cores may be made either in a straight-through or shuttle version.

The installation has passed industrial tests and confirmed a high quality of knocking out, convenience of fitting and operation and reliability of all mechanisms.

What we claim is:

1. An installation for electrohydraulic knockout of casting cores comprising: a liquid in the form of a container shell consisting of a movable upper part and a fixed lower part, both parts being jointed telescopically with each other so that in the extended position the space of the upper part supplements that of the lower part and communicates with it; a pneumatic seal located on the joint between said parts of said shell; a casting support located practically level with the upper face of said lower part of the container shell and fixed rigidly in position; a mechanism for delivering the casting on, and removing it from, said support; at least one electrode holder mounted above said container shell with a provision for moving the electrode to a preset position relative to the casting core; and a hydraulic cylinder for moving vertically the upper part of said liquid container shell.

2. An installation according to claim 1 wherein the length of the movable upper part of the container shell is selected so that in the extended position its upper face would rise approximately 0.6 m above the uppermost point of the casting located in the installation.

3. An installation according to claim 1 wherein the lower part of the container shell has a bell section whose volume is nearly equal to that of the extended upper part of the container shell and communicates with it and with a source of compressed air, said source ensuring a supply of air sufficient for forcing liquid out of the bell section and into the extended upper part said bell section being provided with an air admission valve and an air discharge valve.

4. An installation according to claim 3 wherein said bell section of the shell is formed between the wall of the lower part of the container shell and the vertical circular partition arranged coaxially with said wall and secured practically level with its upper face.

* * * * *